United States Patent [19]

Sandviknes

[11] 4,052,143

[45] Oct. 4, 1977

[54] GAS COMBUSTION PLANT

[75] Inventor: Jan Sandviknes, Oslo, Norway

[73] Assignee: Saxlund A/S, Akland, Norway

[21] Appl. No.: 674,119

[22] Filed: Apr. 6, 1976

Related U.S. Application Data

[63] Continuation of Ser. No. 506,537, Sept. 16, 1974, abandoned.

[30] Foreign Application Priority Data

Oct. 9, 1973 Norway ..... 733913

[51] Int. Cl.[2] ..... F23D 11/44

[52] U.S. Cl. ..... 431/215; 431/11; 431/161

[58] Field of Search ..... 431/11, 215, 161, 115, 431/116

[56] References Cited

U.S. PATENT DOCUMENTS

| | | | |
|---|---|---|---|
| 298,215 | 5/1884 | Lipsey | 431/215 |
| 3,457,121 | 7/1969 | Tomlinson | 431/215 X |

*Primary Examiner*—Edward G. Favors
*Attorney, Agent, or Firm*—Ulle C. Linton

[57] ABSTRACT

A gas combustion plant or apparatus comprising a combustion chamber, a burner for introducing the gas to the combustion chamber and a tubular heat exchanger for preheating the gas to be combusted, by heat exchange with the hot combustion gases. The burner and the tubular heat exchanger are combined in that the straight, parallel tubes are provided in a uniformly distributed pattern over the cross-section of one end portion of the combustion chamber. The end of the tubes adjacent the end of the combustion chamber are connected to an inlet for the gas to be combusted, which are accordingly introduced into the combustion chamber through the tubes at a high velocity creating a desired turbulence in the portion of the combustion chamber in front of the tube orifices. An outlet for the hot combustion gases is positioned adjacent the said one end of the combustion chamber, whereby the hot combustion gases will have to flow past the tubes along the outer side thereof in order to reach the said outlet, thereby preheating the gas flowing inside the tubes. Accordingly, the said end portion of the combustion chamber in which the burner tubes are provided, constitutes a heat exchanger.

5 Claims, 2 Drawing Figures

GAS COMBUSTION PLANT

This is continuation of application Ser. No. 506,537, filed Sept. 16, 1974 abandoned.

BACKGROUND OF THE INVENTION

The present invention relates to a gas combustion plant comprising a combustion chamber, a burner for introducing the gas to the combustion chamber and a tubular heat exchanger for preheating the gas to be combusted, by means of the hot combustion gases.

Since long waste gases having a high content of combustible components have been burned as a torch or in firing plants in order to decompose toxic, explosive or smelling components into relatively harmless components like $CO_2$, $H_2O$ and $SO_2$. Such combustion is nowadays increasingly used also when the content of combustible components in the gas is so low that the gas is not self-combustible and therefore cannot be brought to the temperature (500° to 850° C) necessary for obtaining a sufficient oxidation rate. The gases must also be kept at said temperature for a certain period for the desired degree of oxidation to be obtained. Finally, a good turbulence of the burning gases is important for obtaining a good result.

Known plants for such termic gas purification may comprise a combustion chamber and a burner for introduction of a fuel, such as oil, propane or the like in addition to the gas to be cleaned. Such plants may be used when the gas to be cleaned has a high temperature or a high content of combustible components. In principle the plant is similar to the afterburner chambers used in destruction furnaces for waste and the like. When the gas to be cleaned has a low temperature it may be advantageous to preheat the gas, and this may be effected by heat exchange with the hot exhaust gases. Thus, plants are known having a heat exchanger arranged after the combustion chamber, the hot combustion gases being passed through straight tubes in the heat exchanger, whereas the gas to be burned is passed through the heat exchanger transversely to the tubes in order to be heated and then delivered to the combustion chamber at an inlet end opposite to the outlet end for the exhaust gases. In order to obtain good mixing (turbulence) of burnt and unburnt gas, the combustion chamber may have the form of a vortex or whirl chamber or the gas inlet may be provided with guide blades.

These plants work well, but may require relatively high temperatures, depending on the design of the combustion chamber, in order to obtain a sufficient oxidation of the gas. Especially in the oxidation of CO, which is a relatively heavily oxidizable gas, it may be necessary to maintain a high temperature if the residence time in the combustion chamber is not sufficiently long and the turbulence conditions are not sufficiently good. Especially the transitional portion between the combustion chamber and the heat exchanger is exposed. If a hole should be burned in the heat exchanger in this position a short-circuiting occurs between cold and hot gas, meaning that cold, unpurified gas will be carried along with the hot exhaust gases and not be purified. The flow path of the gas to be heated through the heat exchange involves a tendency for any entrained dust to deposit on the outside of the tubes of the heat exchanger, thereby reducing the heat exchange and increasing the temperature in the heat exchanger tubes with an increasing risk of thermal damages thereof.

SUMMARY OF THE INVENTION

The object of the present invention is to provide a gas combustion plant having a heat exchanger in which these disadvantages have been avoided, and also having a design of the burner and the combustion chamber providing a good mixture of burnt and unburnt gas and thereby good purification of the gas without extremely high temperatures.

The gas combustion plant according to the invention is characterized in that the heat exchanger is constituted of tubes which are arranged longitudinally at one end of the combustion chamber and also serve as a burner, the one end of the tubes adjacent the end of the combustion chamber being connected to a gas inlet and the other end thereof, which extends into the combustion chamber, being in open communication with the combustion chamber, whereas the outlet for the hot combustion gases is so positioned that the gases will have to flow past the tubes along the outer side thereof.

In this arrangement the tubes will, as stated, constitute both a heat exchanger and a burner. The gas to be purified will be introduced into the combustion chamber through the tubes with a high velocity, thus providing a good turbulence in the combustion chamber. Experiments have shown that stationary whirls may be obtained in the combustion chamber, and that the gas flowing into the combustion chamber from the tubes will effect a certain recirculation of partly burnt gases back to the main combustion zone. Because the hot combustion gases flowing at the outside of the tubes are flowing substantially in the axial direction thereof, the tendency for deposits on the tubes will be substantially reduced. Additionally, any deposits on the outer side of the tubes will be on the hot side thereof and, consequently, protect the material in the tubes. Any thermal damages of the tubes at the hottest end thereof, i.e. the outlet end, will not substantially reduce the purifying effect.

The tubes are preferably substantially uniformly distributed over the cross-section of the said one end of the combustion chamber defining the heat exchanger, and the cross-sectional flow area outside the tubes is preferably larger than the total cross-sectional area of the tubes, partly in view of the fact that the gases usually have a larger volume after the combustion, and partly because a larger gas velocity of the cold gas through the tubes than of the hot gas flowing outside the tubes is desirable. The combustion chamber is preferably enlarged at the outlet end of the tubes, i.e. at the burner openings. The tubes preferably extend a distance into the enlarged portion of the combustion chamber.

The combustion chamber is preferably vertically arranged with downwardly directed heat exchanger and burner tubes in its upper portion.

Further features and advantages of the plant according to the invention will appear from the following description of a preferred embodiment, reference being had to the accompanying drawing.

DETAILED DESCRIPTION OF THE PREFERRED EMBODIMENT

Figure 1:
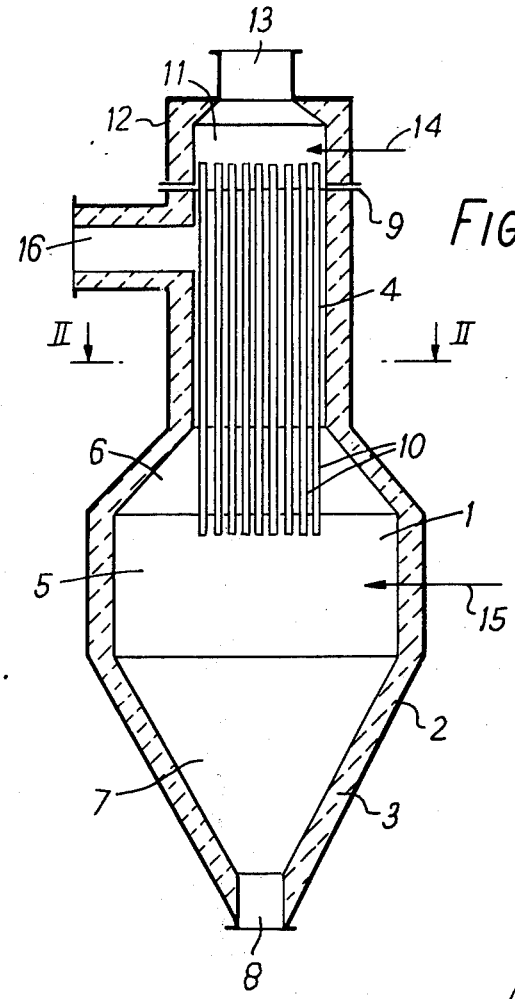
FIG. 1 is a highly diagrammatical vertical section through a combustion plant according to the invention.
Figure 2:
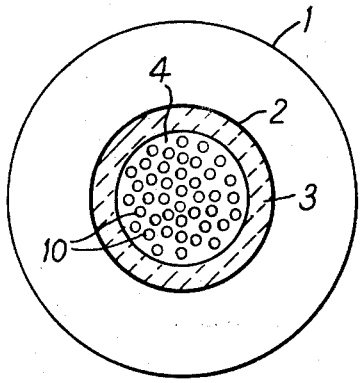
FIG. 2 is a section along the line II—II in FIG. 1.

The gas combustion plant illustrated in the drawing mainly consists of a combustion chamber 1 having an upper cylindrical portion 4, a cylindrical main portion 5 having a larger diameter than the portion 4, a conical transitional portion 6 between the portions 4 and 5 and a conically tapering end portion or bottom 7 having a closable discharge opening 8 for any dust accumulating in the combustion chamber. At the upper end the combustion chamber is closed by a plate 9. This plate carries a number of substantially uniformly distributed tubes 10 extending through the plate and being open in both ends. In the embodiment illustrated in the drawing the tubes 10 extend right down to the portion 5 of the combustion chamber 1. At the upper side of the plate 9 the tubes 10 communicate with a mixing chamber and header 11 defined by an upper hood 12 having an inlet opening 13 for the gas to be combusted. An arrow 14 diagrammatically indicates the possibility of an optional tangential introduction of combustion and cooling air to the gas in the mixing chamber 11. An arrow 15 diagrammatically indicates an optional supply of oil, propane or other fuel in order to maintain the temperature in the combustion chamber at the desired level, even when the content of combustible components in the gas to be purified is low. At the upper end of the combustion chamber 1 an outlet 16 for combustion gases is provided.

The function of the disclosed apparatus is believed to be evident from what has been stated above so that a more detailed discussion will not be required.

What I claim is:

1. Gas combustion plant comprising a combustion chamber, a plate closing one end of said combustion chamber, a hood being mounted on said plate defining a mixing chamber having a gas inlet opening, a plurality of tubes each having an inlet end within said mixing chamber and extending through said plate into and longitudinally of a portion of said combustion chamber adjacent said plate and ending in an axially facing mouth orifice opening into said combustion chamber, said tubes being spaced apart from one another defining a space outside of said tubes within said combustion chamber with said space opening into the portion of said combustion chamber into which said tubes open to provide an open gas exchanging communication between said space and said portion of said combustion chamber, said combustion chamber having an outlet for the hot combustion gases from said combustion chamber, positioned alongside said tubes whereby said gas will flow through said tubes into said combustion chamber and the hot combustion gases will flow through said space outside of said tubes preheating the gas therein, to said outlet, said combustion chamber having a cylindrical portion merging into a flaring portion having flared walls and thus gradually increasing cross-section, said tubes being uniformly distributed over the cross-section of said cylindrical portion and extending into said flaring portion.

2. Gas combustion plant as claimed in claim 1 wherein said combustion chamber is positioned vertically with said cylindrical portion at the upper end thereof and said tubes extend downwardly.

3. Gas combustion plant as claimed in claim 2, wherein said combustion chamber has a conical bottom portion below the open ends of said tubes and said conical bottom portion has a closeable discharge opening for any dust accumulating in said combustion chamber.

4. Gas combustion plant as claimed in claim 1, wherein said combustion chamber has a cylindrical main portion adjacent said flaring portion, said tubes extending through said flaring portion and into said main portion.

5. Gas combustion plant comprising a combustion chamber, a plate closing one end of said combustion chamber, a hood mounted on said plate defining mixing chamber having a gas inlet opening, a plurality of tubes each having an inlet end within said mixing chamber and extending through said plate into and longitudinally of a portion of said combustion chamber adjacent said plate and ending in an axially facing mouth orifice opening into said combustion chamber, said tubes being spaced apart from one another defining a space outside of the tubes within said combustion chamber with said space opening into the portion of said combustion chamber into which said tubes open to provide an open gas exchanging communication between said space and said portion of said combustion chamber, and said combustion chamber having an outlet for the hot combustion gases from said combustion chamber, positioned alongside said tube whereby said gas will flow through said tubes into said combustion chamber and the hot combustion gases will flow through said space outside of said tubes preheating the gas therein, to said outlet.

* * * * *